US006790484B2

(12) United States Patent
Mann

(10) Patent No.: US 6,790,484 B2
(45) Date of Patent: Sep. 14, 2004

(54) METHOD AND APPARATUS FOR CLEANING ELECTROSTATIC PAINTING HOOKS

(76) Inventor: Carlton Mann, 701 Shiloh, Apt. 324, Tyler, TX (US) 75703

( * ) Notice: Subject to any disclaimer, the term of this patent is extended or adjusted under 35 U.S.C. 154(b) by 0 days.

(21) Appl. No.: 10/017,545

(22) Filed: Dec. 14, 2001

(65) Prior Publication Data

US 2003/0113473 A1 Jun. 19, 2003

(51) Int. Cl.[7] ..... B05D 1/02; B05D 1/04

(52) U.S. Cl. ..... 427/475; 427/477; 427/156; 427/195; 427/421

(58) Field of Search ..... 427/154, 156, 427/185, 195, 421–427, 475, 477, 479; 118/635

(56) References Cited

U.S. PATENT DOCUMENTS 2,730,988 A * 1/1956 Starkey
4,069,790 A * 1/1978 Witte
5,114,756 A * 5/1992 Mirabeau et al.
5,617,800 A * 4/1997 Moreschi et al.
5,897,813 A 4/1999 Titomir et al.
5,962,148 A 10/1999 Nishimura et al.

FOREIGN PATENT DOCUMENTS

CA 2099094 * 12/1993

OTHER PUBLICATIONS

Http://www.twp–europe.co.uk/pages/teckpaint.html.
Http://www.circuitsupply.com/catalog/pcp/IMI75.htm.

* cited by examiner

*Primary Examiner*—Fred J. Parker
(74) *Attorney, Agent, or Firm*—John F Bryan

(57) ABSTRACT

A method for isolating non-conductive oxide constituents of paint from the product support hook surfaces of an electrostatic painting conveyor, coats the hooks with a conductive coat of primer paint having from 10% to 80% finely divided conductive materials in a combustible base, and after using the product support hooks for spray painting product units until a non-conductive paint coating builds-up, removes the build-up and the primer coat in a burn-off oven, so as to provide conductive hook surfaces for repeating the process cycle.

15 Claims, 2 Drawing Sheets

METHOD AND APPARATUS FOR CLEANING ELECTROSTATIC PAINTING HOOKS

TECHNICAL FIELD

The present invention relates to the field of electrostatic painting as practiced on a looped chain-type conveyor, and more particularly, to a method and apparatus for cleaning paint deposits from the hooks used to connect process parts to the conveyor.

BACKGROUND

Electrostatic painting is a method for improving the efficiency of depositing paint on a process part by placing an electrical charge on the paint and grounding the part, so that there is a mutual attraction. The process first came into commercial use after World War II in the automobile industry and has since become a commonly accepted practice. Generally, products to be painted are attached to the chain of a looped overhead or in-floor conveyor, and pass through an enclosure for spray painting. In a variation of this process, the product is dipped in paint. Usually, the conveyor is electrically connected to ground, and the paint spray gun or tank is connected to the charged side of a grounded D.C. system. Product supporting hooks, which may be simple, hook shaped members, or elaborate wire frames adapted to support a specific part or product, are attached to the conveyor chain at spaced intervals. In this manner, the hook members become connecting links, joining the product into the electrostatic system. As a result, the paint hooks attract their share of paint with each pass through the system. These layers of paint will build-up to a point that reliable electrical connections cannot be made between the hooks and the process parts, disabling the effect of the electrostatic field.

The paint build-up can be removed in various ways, the most efficient being by use of a burn-off oven, preferably a controlled atmosphere burn-off oven as described in my U.S. Pat. No. 5,189,963. In this process, the hooks are removed from the conveyor, stacked on carts designed for the purpose and oven baked to burn-off the paint build-up. The burn-off oven method for hook cleaning is preferred as being environmentally acceptable and economical, but if a burn-off oven is not available, the paint hooks can be cleaned by media blasting, chemical stripping or manual methods.

In the burn-off process, oven heat is controlled, so as to reduce the paint to ash in an environmentally acceptable manner. Titanium dioxide, included in virtually all paint formulations, is unaffected by the heat of the oven, so that a residual titanium dioxide coating remains on the surface of the hooks. This coating is non-conductive and must be removed from the hooks, at least in the areas of product contact, by an additional step involving a mechanical, chemical or manual process. Even with the additional step, use of the burn-off oven for hook cleaning is more economical than chemical stripping or other alternatives.

SUMMARY OF THE INVENTION

A first object of the present inventions is therefore, to provide effective methods and apparatus for removal of paint from electrostatic painting conveyor hooks. A second object is that the methods and apparatus provided also be effective for removal of the residual, non-conductive titanium dioxide. A third object of the present inventions is to provide methods and apparatus more efficient and economical than current practices. Yet a fourth object is to provide environmentally acceptable methods and apparatus for paint hook cleaning.

The present inventions address the foregoing objects in a direct manner by eliminating contact between titanium dioxide bearing paint and the surface of the product support hook. The apparatus of the present inventions comprises an electrostatic painting enclosure with a conveyor, product support hooks for the conveyor, an electrically conductive primer paint with a combustible base, for pre-coating the product support hooks, and preferably, a burn-off oven. While the other elements of the present invention are well known to those knowledgeable in the painting arts, the application of an electrically conductive coat of paint with a combustible base is unique. This primer paint may have up to 80% by volume of finely divided carbon or other suitable conductive material in a combustible, hardening base. Virtually any polymeric, epoxy or other conventional paint base, well known in the painting arts may be used to make this paint combustible as well as conductive. The coating may be applied in liquid or powder form by any of the means known to those skilled in the painting arts.

During electrostatic painting, a non-conductive coating of paint will build-up on the product support hooks, interfering with the product-to-hook ground connection in the next cycle of use. The paint build-up and combustible base coat are turned into ash in a burn-off oven and fall easily from the product support hooks. The primer coating prevents direct contact of the paint build-up with the hook surface, so that the titanium dioxide residue falls away with the ash. In this manner, good electrical conductivity is assured for reuse of the paint hooks. If the same product is to be painted throughout an extended production run, so that the product support hooks need not be changed for reasons other than cleaning, the burn-off oven may be incorporated into the conveyor path so as to provide a continuous process line. Even if a burn-off oven is not used, the conductive, combustible base coat isolates the titanium dioxides of pigmented paints from the paint hook surfaces, so as to facilitate cleaning by any other means.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
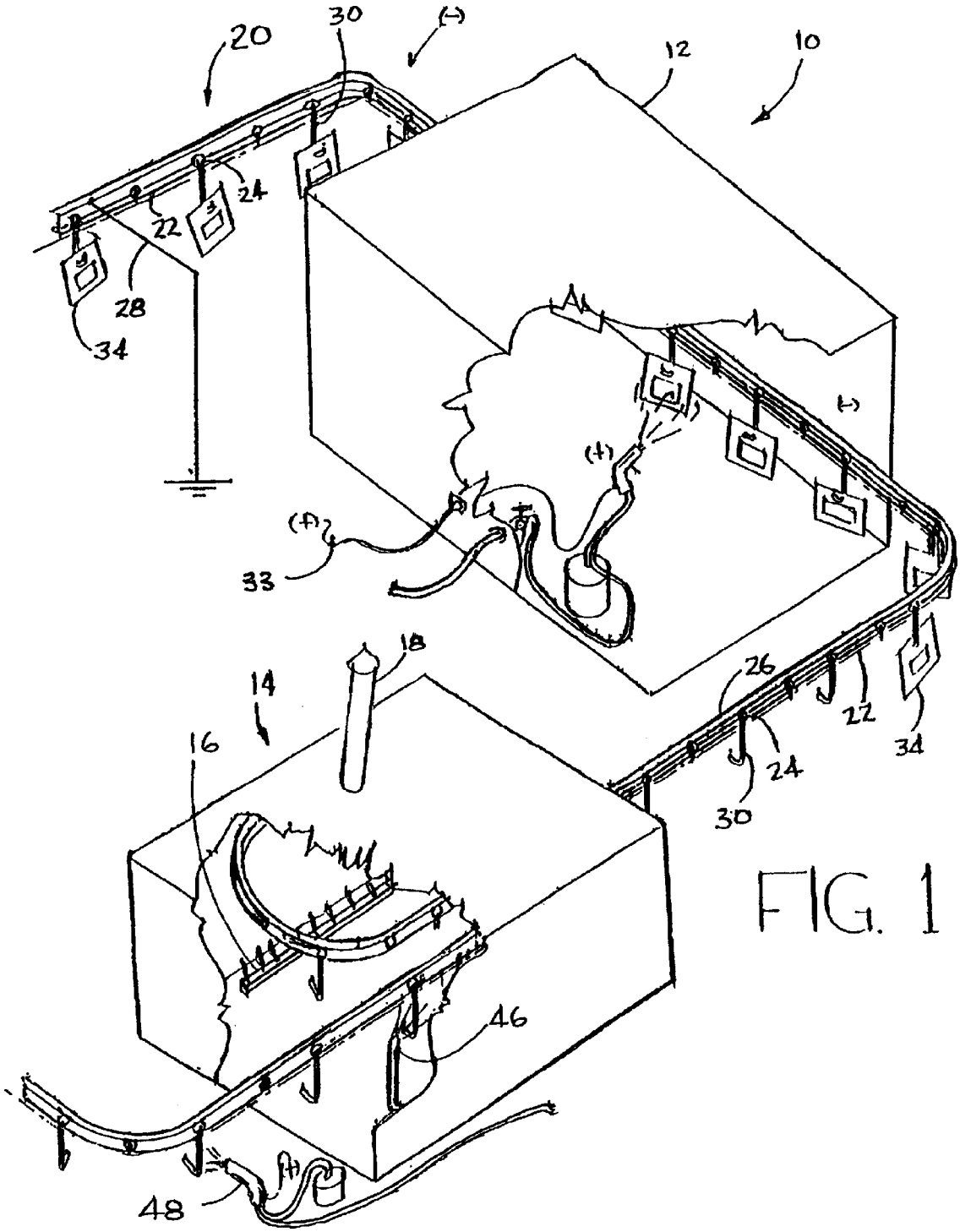
FIG. 1 is a perspective view of a preferred embodiment of the electrostatic spray painting apparatus of the present inventions.

The present inventions are described in the following by referring to drawings of examples of how the inventions can be made and used. In these drawings, reference characters are used throughout the views to indicate like or corresponding parts. The embodiments shown and described herein are exemplary. Many details are well known in the art, and as such are neither shown nor described.

FIG. 1 is a perspective view showing electrostatic spray painting apparatus 10 in a preferred embodiment of the present inventions. Enclosure 12 surrounds the paint application area, through which endless conveyor 20 passes. In this embodiment, conveyor 20 also passes through burn-off oven 14 with gas fired burners 16 and exhaust stack 18, so as to provide a continuous painting/cleaning process. Water spray 46 washes the remaining ash from paint hooks 30 and the residual heat dries them quickly, so as to be ready to receive a fresh, conductive primer coat. This primer coat may be applied by spray gun 48, as shown in FIG. 1, or by other well known means such as dipping or powder coating. This arrangement is appropriate to single product applications, wherein the product support hooks 30 need not be changed regularly to accommodate different products. In other circumstances, wherein product support hooks 30 are changed frequently, burn-off oven 14 might be a separate, batch-loaded unit.

Conveyor 20 comprises endless conveyor chain 22, supported at regular spaced intervals by trolley assemblies 24 running in track 26. Product support hooks 30 are removably attached to conveyor chain 22 at spaced intervals, the locations preferably coinciding with the locations of trolley assemblies 24. Product support hooks 30 may be simple, hook shaped members as shown, or elaborate wire frames adapted to support a specific part or product. Paint spray gun 32 may be either manually or computer controlled, but in any case, it is electrically connected to the ungrounded, charged side 33 of the electrostatic system. Thus, paint sprayed from paint spray gun 32 carries this electrostatic charge.

Conveyor track 26 is connected to ground 28, so as to also ground trolley assemblies 24, conveyor chain 22, product support hooks 30 and product parts 34. The charged paint from paint spray gun 32 is attracted to grounded product parts 34 and, as a consequence, also to product support hooks 30. In order to limit the degree of paint over-spray, spray gun 32 is directed so that electrostatic attraction of the paint is primarily to product parts 34, but even so, a significant amount of paint is carried to product support hooks 30. Conveyor chain 22 and trolley assemblies 24 are relatively remote, so as to be more or less protected from paint over-spray and, in any case, relative movement of these parts breaks down any paint coating that may be deposited on them. After one or more trips around the conveyor loop, a non-conductive layer of paint will build-up on product support hooks 30, making electrical connectivity to product parts 34 uncertain for the next successive painting cycle.

Figure 2:
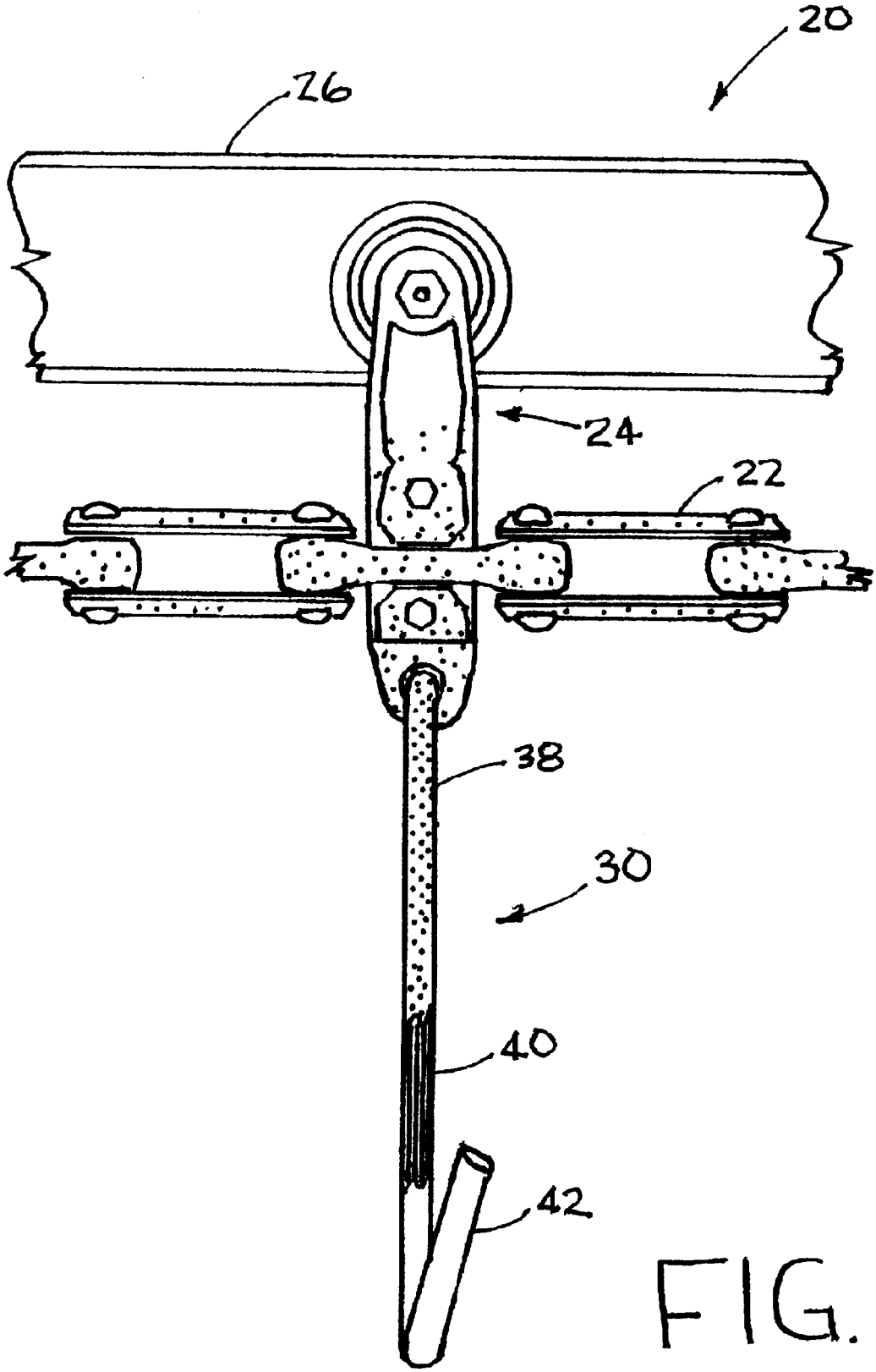
FIG. 2 is a view of a portion of the conveyor of FIG. 1, with a product support hook partially stripped to show the conductive coat and an overlying paint build-up.

FIG. 2 is a view of product support hook 30 of the present inventions, as used in the apparatus of FIG. 1. As stated earlier, product support hooks may be simple, hook shaped members, or elaborate wire frames adapted to support a specific part or product. Paint build-up 38, deposited through one or more passes through the enclosure 12 of FIG. 1, is shown as being partially stripped away to expose the underlying base coat 40. In turn, base coat 40 is shown as being partially stripped away to expose the bare metal surface 42 of product support hook 30. Application of the electrically conductive base coat 40, of the present inventions, serves to prevent the deposit of non-conductive oxides directly on the hook surface 42. Thus, these non-conductive oxides fall off as part of the paint ash left by the burn-off oven, and good conductivity is assured for the reuse of hooks 30. After hardening, and loss of water and/or volatile constituents, base coat 40 may comprise as much as approximately 80% finely divided carbon or other suitable conductive material in a solidified binder. Carbon is preferred as the conductive material, because its combustibility complements that of the vehicle/binder base material, and it is also inexpensive. The chemistry of the coat vehicle/binder is not critical, so long as it hardens and is combustible. Paint and non-conductive oxide deposits from electrostatic painting are thus, prevented from bonding directly to the surface of the product support hooks 30. The vehicle/binder base material of conductive primer coating 40 breaks down in the burn-off oven, except for a non-adhering ash. In this manner, the paint ash and non-conductive oxides, together with ash from conductive coat 40, separate freely from product support hooks 30. The conductive material of base coat 40 is selected to either be completely combustible or leave a conductive residue. Finely divided or powdered carbon, certain conductive polymers, iron or steel and nickel are suitable examples of such materials.

The process could be used for coating any conductive surfaces in addition to hooks in a painting process.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, composition and arrangement of the elements within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. A method for isolating paint with a non-conductive oxide constituent from a conductive surface to facilitate cleaning thereof, comprising the steps of:

providing a conductive, primer coat having up to 80% finely divided conductive material by volume dispersed in a combustible, hardening base;

applying the conductive primer coat to the conductive surface and allowing the base to harden applying a paint having a non-conductive oxide constituent over the primer coat and allowing the paint coat to harden; and removing the paint and non-conductive oxide constituent, together with the combustible base primer coat, so as to provide a clean conductive surface for application of another primer coating.

2. The method of claim 1 wherein the finely divided conductive material is carbon.

3. The method of claim 1 wherein the conductive primer coating is applied to the conductive surface by spray painting.

4. The method of claim 1 wherein the conductive primer is applied to the conductive surface by powder coating.

5. The method of claim 1 wherein the step of removing is implemented by burning-off.

6. The method of claim 1 and further comprising the step of removing is implemented chemically.

7. The method of claim 1 and further comprising the step of removing is implemented mechanically.

8. A method for isolating paint with a non-conductive oxide constituent from product support hooks, as used for electrostatic painting, comprising the steps of:

providing a conductive primer paint having up to approximately 80% by volume of a finely divided conductive material dispersed in a hardening, combustible base;

applying the conductive primer coating to the product support hooks and allowing the base to harden;

attaching product units to the product support hooks for painting;

grounding the product support hooks, so that electrical continuity is established through the conductive primer to the product units;

providing electrostatically charged paint having a non-conductive oxide constituent; and electrostatically attracting the charged paint to the grounded product units and the conductive primer coating of the product support hooks, so as to paint the product units, thereby also depositing paint on the conductive primer coating.

9. The method of claim 8 wherein the finely divided conductive material is carbon.

10. The method of claim 8 wherein the conductive primer coating is applied to the conductive surface by spray painting.

11. The method of claim 8 wherein the conductive primer is applied to the conductive surface by powder coating.

12. The method of claim 8 and further comprising the step of:

burning-off the paint and non-conductive oxide constituent, together with the combustible base primer coating, from the support hooks, so as to provide a clean conductive surface for application of another primer coating.

13. The method of claim 8 and further comprising the step of:

chemically removing the non-conductive oxide bearing paint, together with the primer coat, from the support hooks, so as to provide a clean conductive surface for application of another primer coating.

14. The method of claim 8 and further comprising the step of:

mechanically removing the paint and non-conductive oxide constituent, together with the base coat, from the support hooks, so as to provide a clean conductive surface for application of another primer coating.

15. The method of claim 8 and further comprising the step of:

manually removing the paint and non-conductive oxide constituent, together with the base coat, from the support hooks, so as to provide a clean conductive surface for application of another primer coating.

* * * * *